US006439983B1

(12) United States Patent
McCoy et al.

(10) Patent No.: US 6,439,983 B1
(45) Date of Patent: Aug. 27, 2002

(54) SANDING AND CLEANING DEVICE FOR DRYWALL BULLNOSE CORNERBEADS

(75) Inventors: Charles D. McCoy; Roy A. Yahraus, both of Sarasota, FL (US)

(73) Assignee: Pro-Line, Inc., Sarasota, FL (US)

( * ) Notice: Subject to any disclaimer, the term of this patent is extended or adjusted under 35 U.S.C. 154(b) by 18 days.

(21) Appl. No.: 09/716,132

(22) Filed: Nov. 17, 2000

(51) Int. Cl.[7] ..... B24B 23/00
(52) U.S. Cl. ..... 451/354; 451/524
(58) Field of Search ..... 451/523, 524, 451/525, 354, 344, 490, 502, 557, 558

(56) References Cited

U.S. PATENT DOCUMENTS

| | | | |
|---|---|---|---|
| 1,927,574 | A | 9/1933 | Parks |
| 2,402,069 | A | 6/1946 | Minnick et al. |
| 3,648,418 | A | 3/1972 | Churchich |
| 3,878,581 | A | 4/1975 | Perna |
| 4,230,441 | A | 10/1980 | Heronema |
| 4,330,964 | A | 5/1982 | Martinez |
| 4,619,013 | A | 10/1986 | Yon |
| 4,823,515 | A | 4/1989 | Blome |
| 4,878,317 | A | 11/1989 | Ovens |
| 4,907,955 | A | 3/1990 | Snipes |
| 4,923,316 | A | 5/1990 | Fattal |
| 4,946,360 | A | 8/1990 | Brown |
| 5,069,610 | A | 12/1991 | Milburn |
| 5,131,193 | A | 7/1992 | Demers |
| 5,203,885 | A | 4/1993 | Pastre et al. |
| 5,368,461 | A | 11/1994 | Murphy |
| 5,392,484 | A | 2/1995 | Stoltzfus |
| 5,544,384 | A | 8/1996 | Forselius et al. |
| 5,545,287 | A | 8/1996 | Carlson |
| 5,638,570 | A | 6/1997 | Gruner |
| 5,690,547 | A | 11/1997 | Holland, Jr. et al. |
| 5,759,090 | A | 6/1998 | Kawate et al. |
| 5,895,316 | A | 4/1999 | Williams |
| D411,672 | S | 6/1999 | McCoy |
| 5,947,803 | A | 9/1999 | Gruner |
| 5,954,571 | A | 9/1999 | Case |
| 5,993,306 | A | 11/1999 | McCoy |

FOREIGN PATENT DOCUMENTS

| | | | |
|---|---|---|---|
| DE | 3808138 | A1 | 3/1988 |

*Primary Examiner*—Robert A. Rose
(74) *Attorney, Agent, or Firm*—Charles J. Prescott

(57) ABSTRACT

A device for abrading and finishing excess cured filler material from a bullnose outside cornerbead connected between immediately adjacent sheets of drywall. The device includes an elongated rigid body having a generally concave-shaped central longitudinal portion which replaceably receives a highly compressible elongated abrasive member which is substantially coextensive with, and arcuately formable to match against the bullnose cornerbead convex contours. A guide runner extends along either longitudinal side margin of the central longitudinal portion. These guide runners substantially match and glide along the outside angle between the adjacent drywall sheets when there is substantial compression in thickness of the abrasive member firmly engaged against the bullnose cornerbead.

4 Claims, 7 Drawing Sheets

SANDING AND CLEANING DEVICE FOR DRYWALL BULLNOSE CORNERBEADS

BACKGROUND OF THE INVENTION

1. Scope of Invention

This invention relates generally to devices for sanding and finishing drywall installations, and more particularly to a device for cleaning and finishing outside bullnose joints between adjacent sheets of drywall.

2. Prior Art

There are a number of prior art devices used for finishing drywall installation corners and surfaces. Some of these devices known to applicants are directed to the application of cementious drywall filler compound; the majority of these devices, however, are directed to the sanding, scraping or finishing of the cured drywall compound prior to painting or wallpapering the finished drywall surfaces.

The following U.S. patents are known to applicant which generally fit into this category of prior art devices:

| | |
|---|---|
| U.S. Pat. No. 5,544,384 | Forselius, et al. |
| U.S. Pat. No. 3,878,581 | Perna |
| U.S. Pat. No. 5,545,287 | Carlson |
| U.S. Pat. No. 4,907,955 | Snipes |
| U.S. Pat. No. 4,946,360 | Brown |
| U.S. Pat. No. 5,069,610 | Milburn |
| U.S. Pat. No. 4,619,013 | Yon |
| U.S. Pat. No. 4,230,441 | Heronema |

U.S. Pat. No. 5,368,461 Murphy

All of these above prior art devices are either adapted to fill or finish flat drywall surfaces or inside or outside drywall joint areas which have sharp or crisp inside or outside corners, respectively.

A recently introduced feature for drywall outside corner joints is typically referred to as a "bullnose" cornerbead or joint. These outside radiused cornerbeads are formed of elongated metal strips which define an arcuate or radiused quarter circle sector or other similar sector cylindrical surface and are attached to the adjacent aligned edges of drywall panels.

The invention disclosed in U.S. Pat. No. 5,638,570 invented by Gruner teaches a drywall bullnose cleaner tool which scrapes excess filler compound from the radiused surfaces of an outside bullnose cornerbead of such a drywall installation. However, scraping action may not be rest suited for optimal smooth finishing of the bullnose cornerbead. Another device for the scraping, cleaning and finishing of bullnose cornerbeads is disclosed by Stolzfus in U.S. Pat. No. 392,484. Again, the scraping of the cylindrical bullnose surface is not fully effective in producing ha smooth, high quality finished surface ready for painting.

I was recently co-inventor of two U.S. patent, U.S. 5,993,306 and U.S. Des. 411,672. These devices generally teach a cleaning and finishing device for bullnose cornerbeads or joints which more gently and uniformly abrades away excess cured or hardened drywall filler compound without concern for overly abrading or grooving the drywall filler compound immediately adjacent the side margins of the metal bullnose cornerbead. Further, by including a somewhat resilient or compliant abrasive fibrous pad which accomplishes the cleaning and finishing action, any non-uniformity of the bullnose joint is easily accommodated.

The following additional prior art references are known to applicant as follows:

| | |
|---|---|
| U.S. Pat. No. 1,927,574 | Parks |
| U.S. Pat. No. 2,402,069 | Minnick, et al. |
| U.S. Pat. No. 5,690,547 | Holland, Jr., et al. |
| U.S. Pat. No. 4,923,316 | Fattal |
| DE 3808138A1 | Lazar |
| U.S. Pat. No. 5,954,571 | Case |
| U.S. Pat. No. 5,947,803 | Gruner |
| U.S. Pat. No. 5,895,316 | Williams |

The later three of these references are also directed to the sanding of rounded bullnose cornerbeads as is intended for the present invention. However, all have structural features and limitations which render them generally ineffective and even damaging to the filler plaster immediately adjacent to the hard typically metallic surface of the bullnose cornerbead.

Additionally, as disclosed in my prior '306 patent, the preferred abrasive medium was in the form of an open non-woven fibrous abrasive material such as that known as SCOTCH-BRITE by the 3M Company. Although this abrasive medium has offered a substantial improvement over conventional sanding paper against a hard radius or arcuate support surface, nonetheless the compressibility of the SCOTCH-BRITE material has not been ideal for the intended objective of removing all excess filler material from the bullnose corner without abrading the adjacent filler material.

The present invention provides still further improvement and sanding accuracy in cleaning excess material from bullnose cornerbeads while avoiding the excess abrasion and grooving of the drywall filler compound immediately adjacent the margins of the bullnose cornerbead.

BRIEF SUMMARY OF THE INVENTION

This invention is directed to a device for abrading and finishing excess cured filler material from a bullnose cornerbead which forms an outside corner joint between immediately adjacent sheets of drywall. The device includes an elongated rigid body having a generally concave-shaped central longitudinal portion which receives a highly compressible thick foam-backed adhesive member which is preferably substantially coextensive with, and arcuately compressibly formable to match the radiused bullnose joint contour. Two spaced parallel guide rails extend longitudinally of the device adjacent each side margin of the central longitudinal portion which, in cooperation with the compressible abrasive member is mateingly engageable against the bullnose corner to substantially match the outside corner angle between the adjacent drywall sheets when the device is pressed firmly against the bullnose corner.

It is therefore an object of this invention to provide an improved sanding and cleaning device for removing and finishing bullnose cornerbead joints of drywall installations.

It is another object of this invention to provide a device for sanding and cleaning excess drywall filler or fairing compound from metal strips which form radiused bullnose joints between adjacent drywall panels.

It is still another object of this invention to provide a device for sanding and cleaning bullnose joints of drywall installations which readily accommodate any irregularity in the metallic strip forming these bullnose joints.

It is a further object of this invention to provide a device for sanding and cleaning excess drywall filler compounds from bullnose corner joints which include a replaceable elongated highly compressible abrasive pad or member.

In accordance with these and other objects which will become apparent hereinafter, the instant invention will now be described with reference to the accompanying drawings.

DETAILED DESCRIPTION OF THE INVENTION

Figure 1:
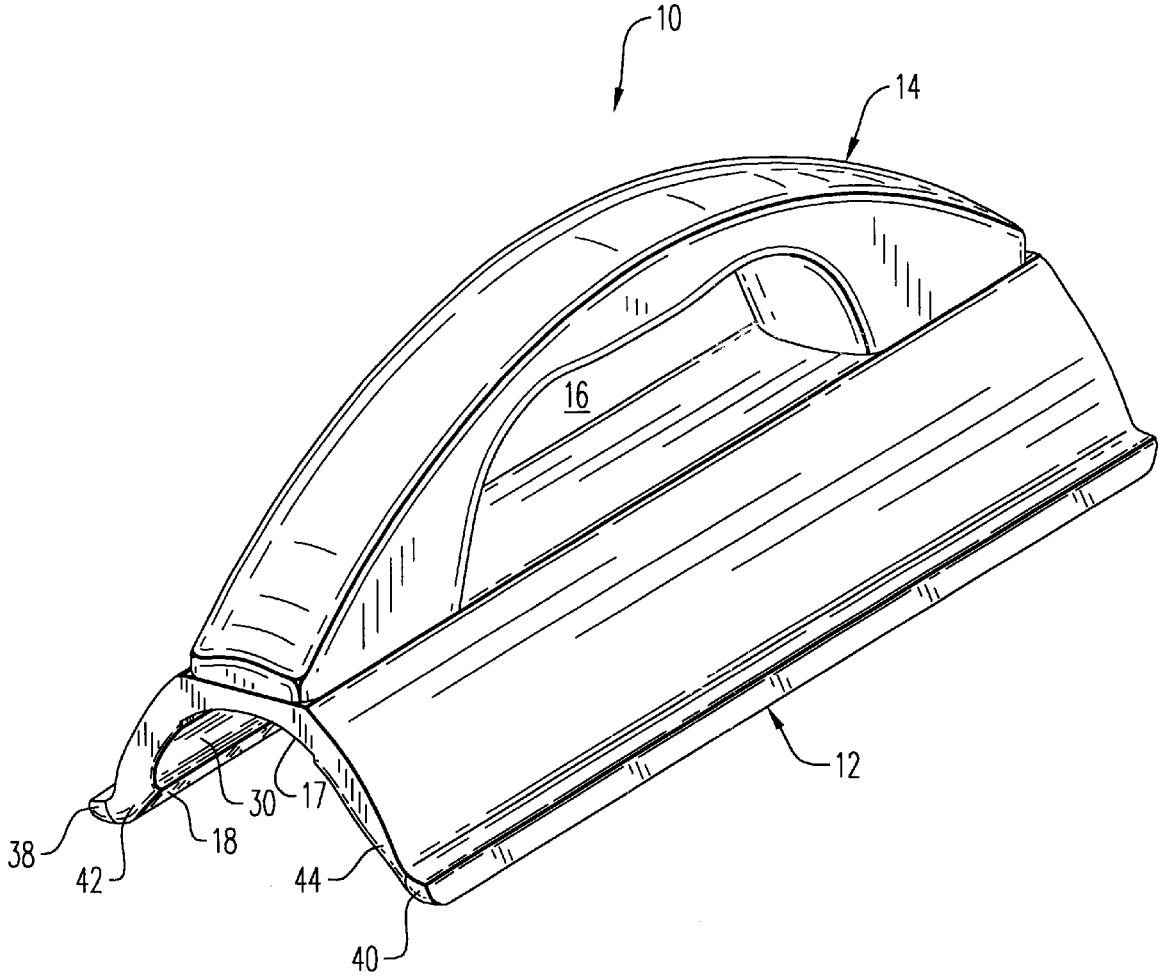
FIG. 1 is a perspective view of the invention absent the replaceable abrasive member.
Figure 2:
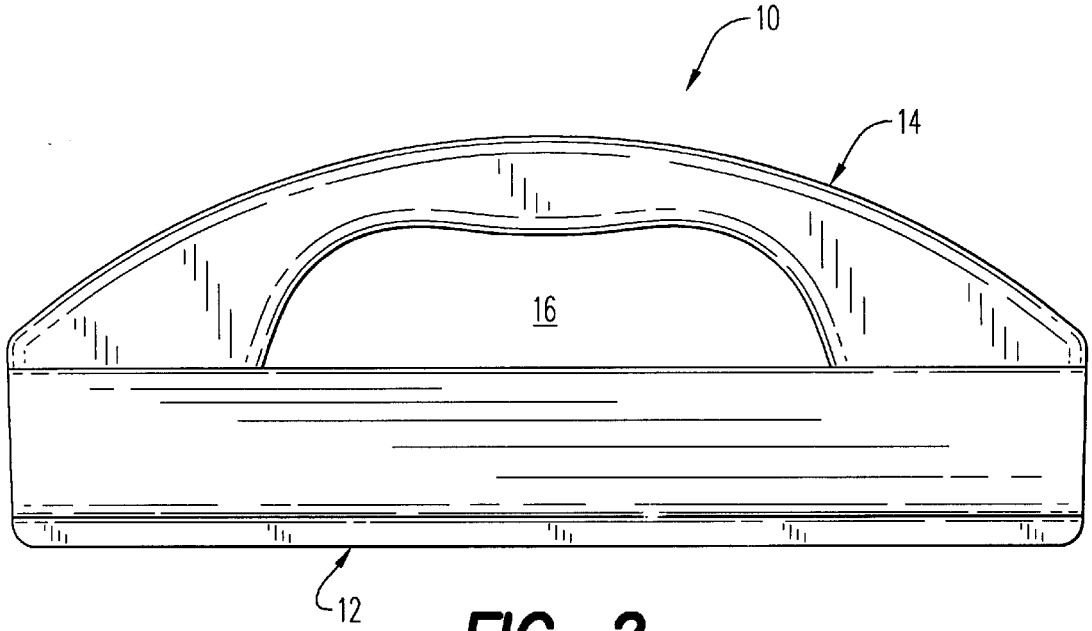
FIG. 2 is side elevation view of FIG. 1.

Referring now to the drawings and firstly to FIGS. 1 to 5, the invention is shown generally at numeral 10. This sanding and abrading device 10 includes an elongated molded plastic rigid body 12 having a handle 14 attached to the convex or back surface thereof which defines a hand-holding opening 16 for grasping by a user. Alternate holding means such as connection to an elongated sanding pole are envisioned.

Figure 3:
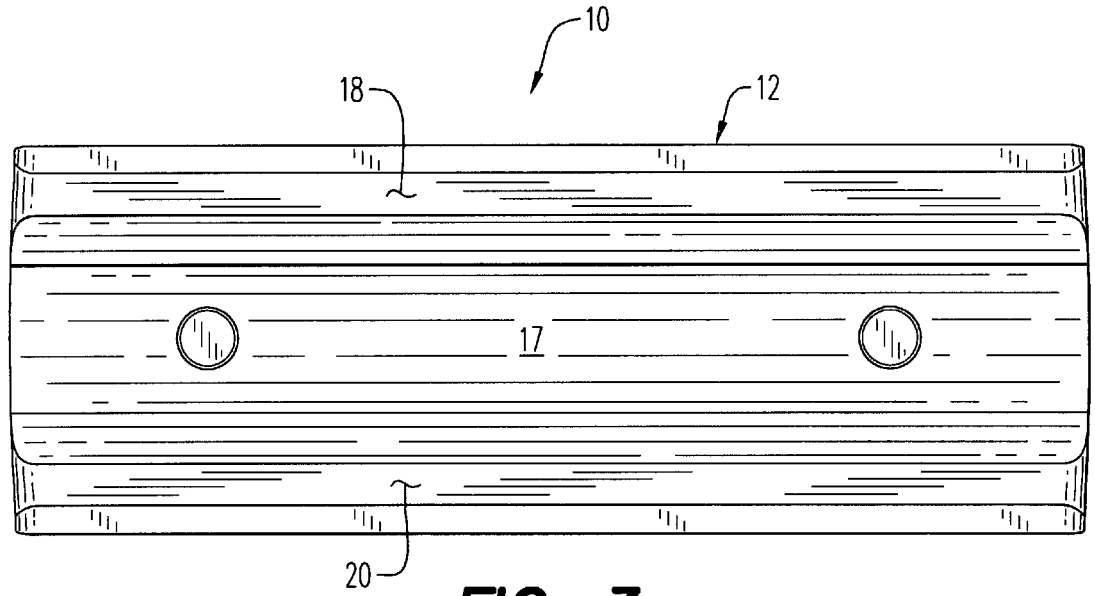
FIG. 3 is a bottom plan view of FIG. 1.
Figure 4:
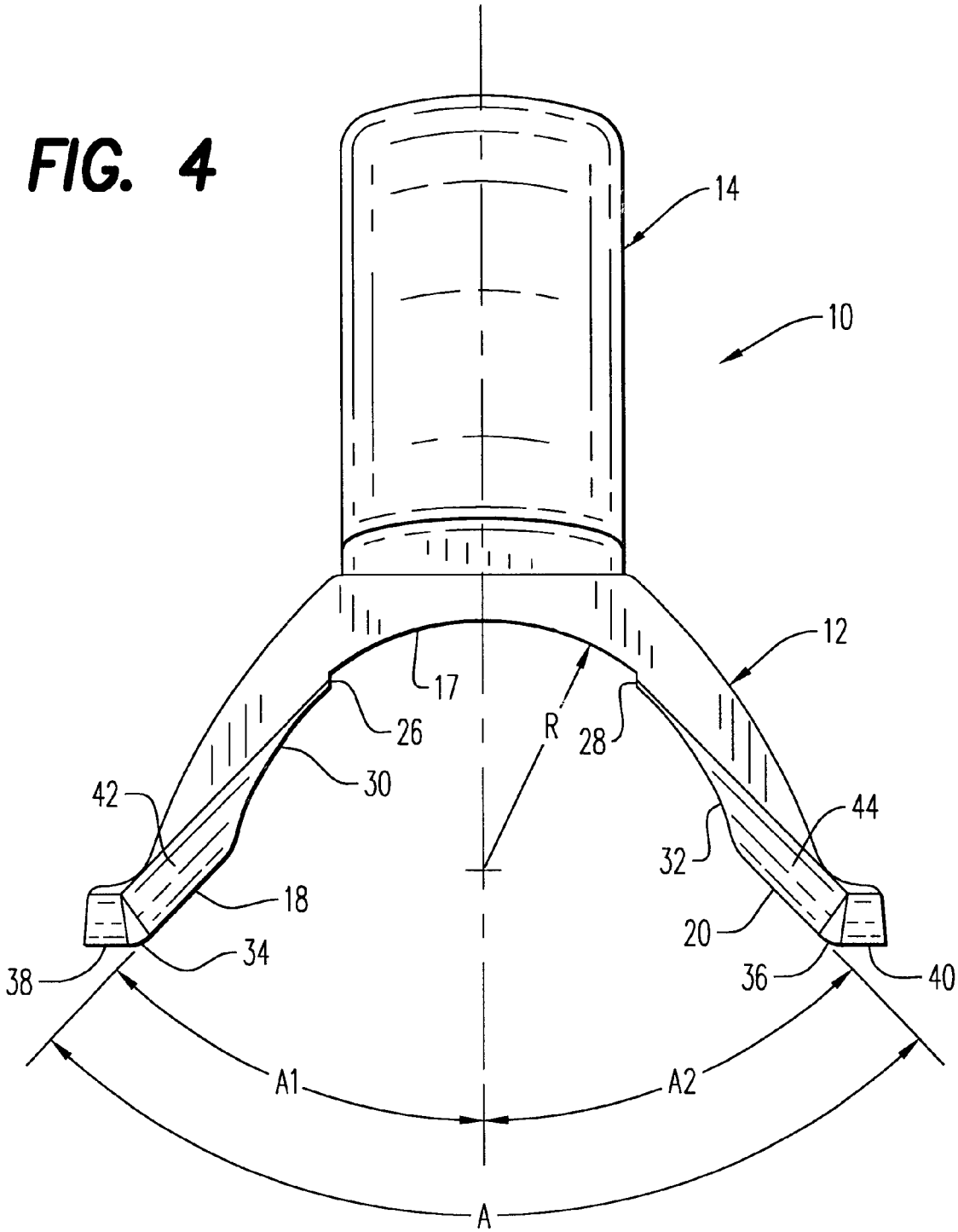
FIG. 4 is an end elevation view of FIG. 1.
Figure 6:
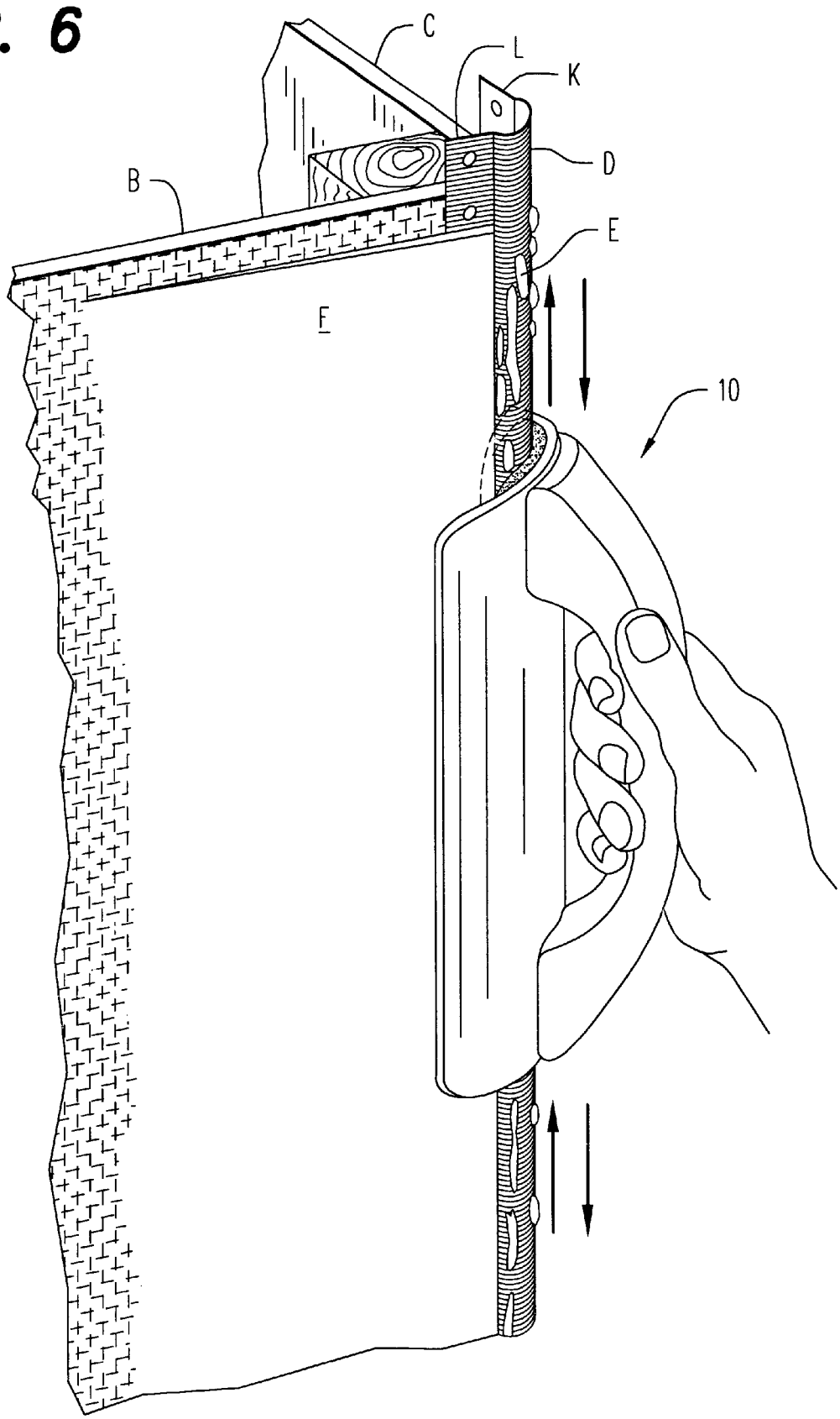
FIG. 6 is a perspective view of the invention shown in FIG. 1 in use in the removal of excess drywall filling compound from a typical bullnose corner joint.
Figure 7A:
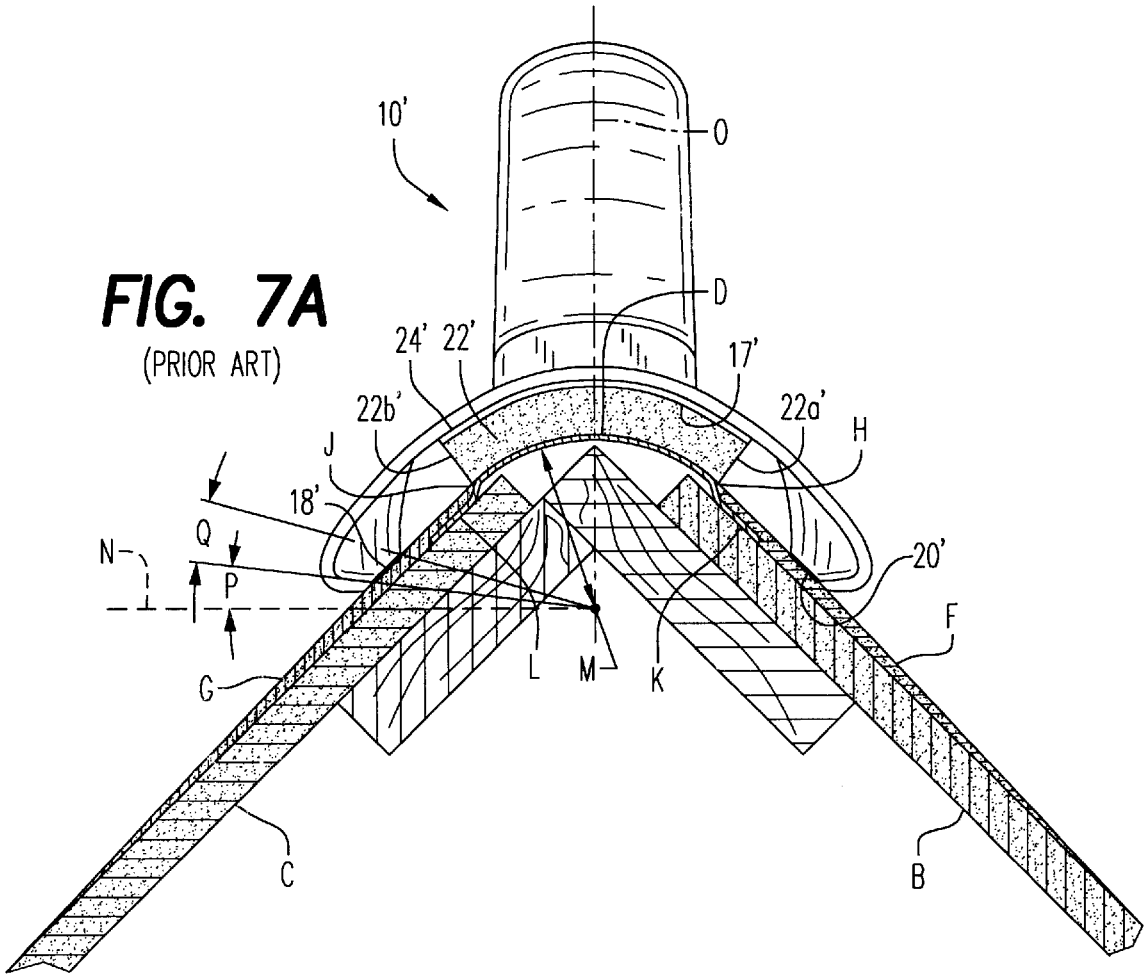
FIG. 7A (PRIOR ART)
FIG. 7A is an enlarged end elevation view of the prior device of U.S. Pat. No. 5,993,306 showing a typical bullnose corner joint in section for reference.
Figure 7B:
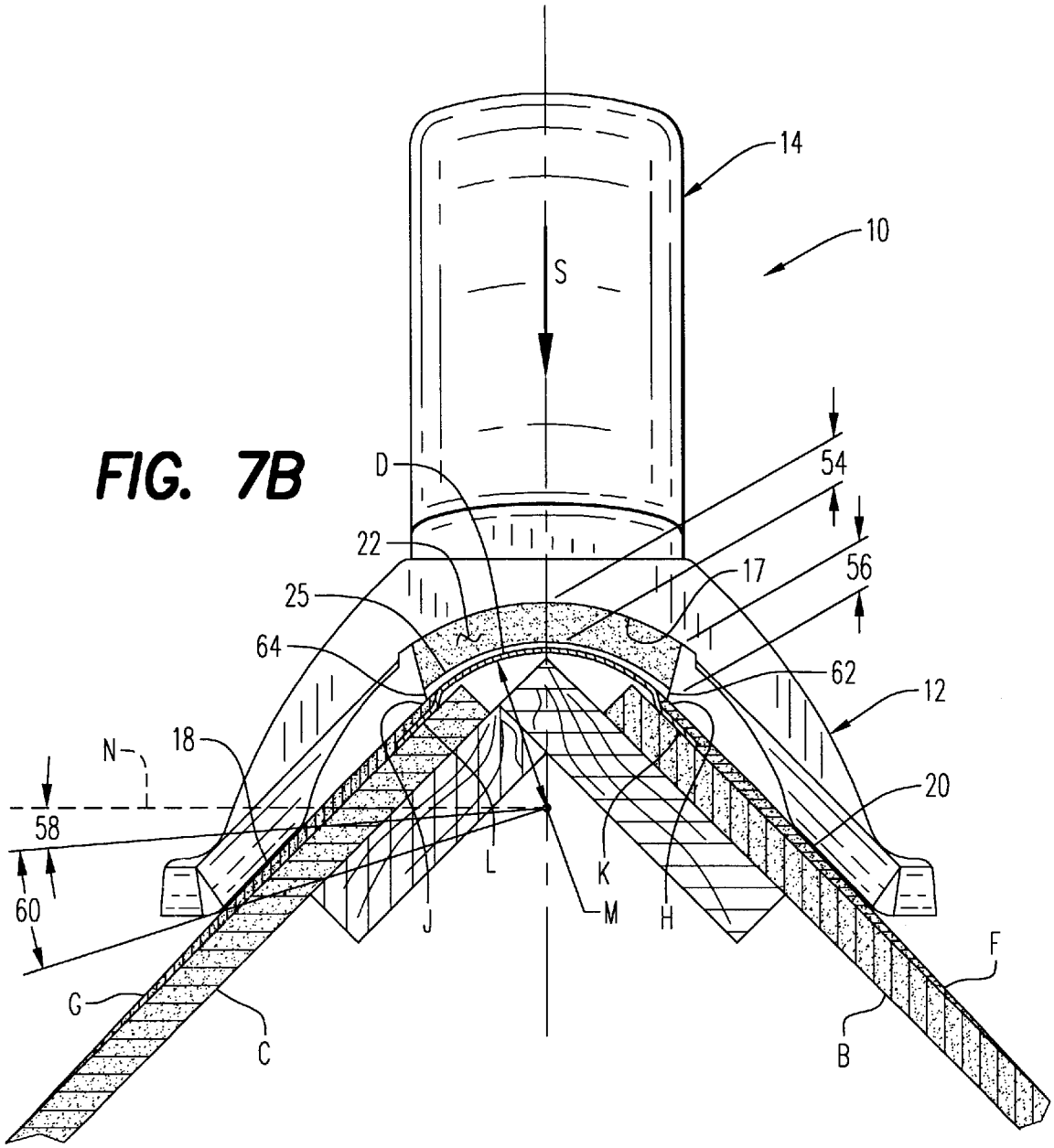
FIG. 7B is a view similar to FIG. 7A showing the present invention in functional engagement with the bullnose corner joint.

As best seen in FIG. 3 and 4, the inner or facing surface 17 of the molded body 12 is generally concaved and circular and cylindrical in nature having a radius R. Spaced, parallel longitudinally extending flat guide runners or rails 18 and 20 extend along and adjacent the longitudinal side margins 38 and 40 of the body 12 and define an angle A as seen in FIG. 4 which is substantially equal to the outside angular orientation between adjacent drywall sheets B and C as shown in FIGS. 6, 7A and 7B. Although drywall corners are typically orthogonal, the invention is easily adapted to any broad range of outside angles such as 60°, 120° and the like as called for by architectural design choice.

As best seen in FIGS. 6, 7A and 7B, the bullnose cornerbead D is attached by its longitudinal mounting flanges K and L to the supporting drywall sheets B and C as by nailing therethrough. Thus, the exposed rounded cylindrical outer surface of the bullnose cornerbead D will ultimately have to be finish sanded before painting. A layer of cementious-type drywall filler compound is first applied along F and G so as to fair or feather in the longitudinal edges H and J of exposed central portion of the bullnose cornerbead D. When the cementious material is applied, typically the radiused or contoured rounded portions of the bullnose cornerbead D are also inadvertently covered with this cementious filler material as at E in FIG. 6. When cured, it must be removed and smoothly finished to receive paint or other coating materials thereafter. Note that the invention 10 is intended to substantially avoid contact with these faired filler portions F and G as that is left to other drywall sanding implements of a more suitable, generally flat nature.

Figure 5:
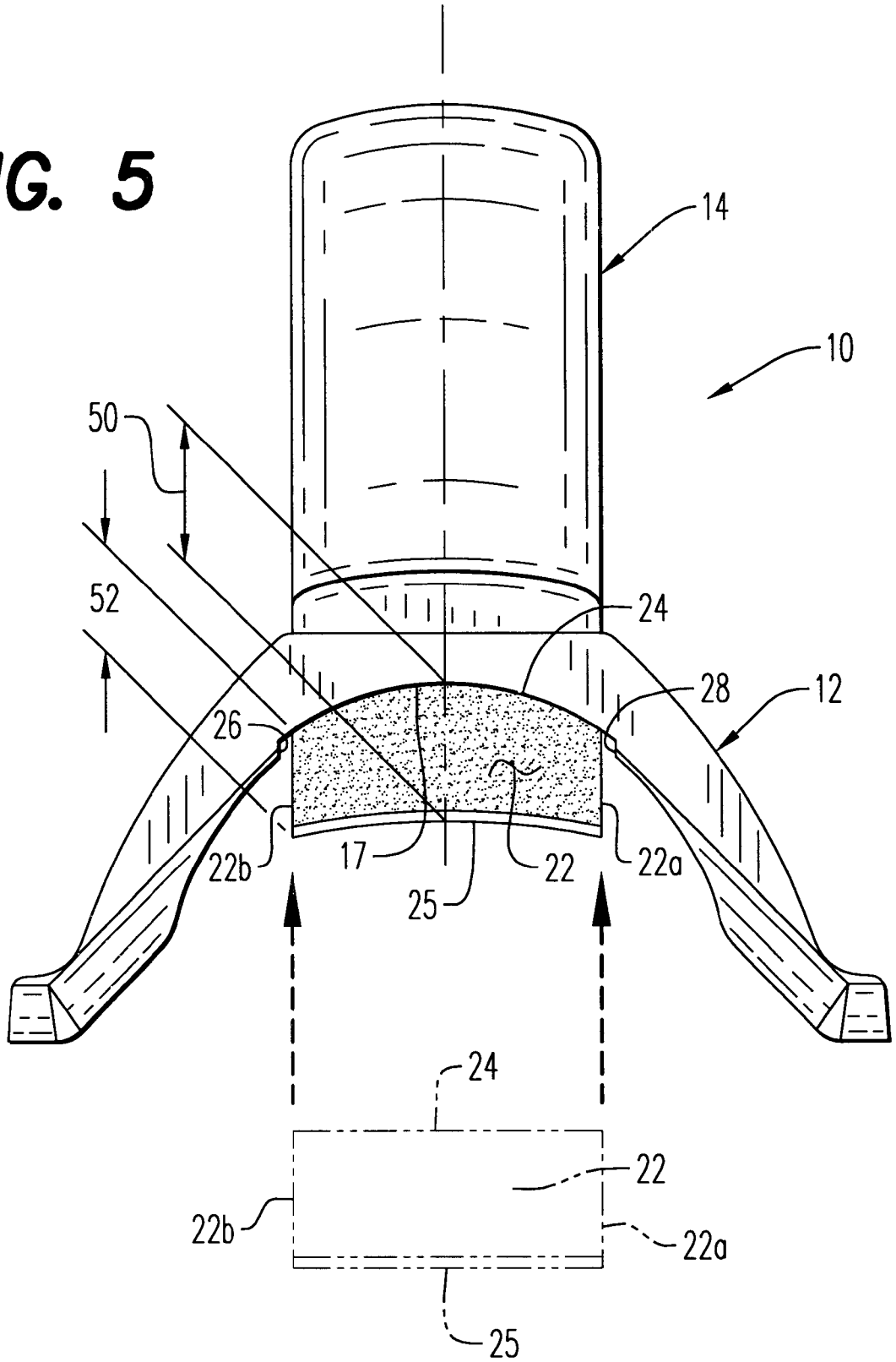
FIG. 5 is an end elevation view of FIG. 1 showing the replaceable abrasive member attached thereto.

The present invention 10 includes several distinctive features which have afforded enhanced operability of the device 10 for its intended purpose. The facing surface 17, having a radius R, terminates at 26 and 28 to define alignment recesses or edges for accurate placement and adhesive attachment of the abrasive member 22 as best seen in FIGS. 4 and 5. Moreover, each of the guide runners 18 and 20 have been enlarged and, by the lengthening of arcuate concave relief surfaces 30 and 32, which allow debris to drop downwardly and be cleared from between the device 10 and the cornerbead D, extend further from the bullnose cornerbead D as best seen in FIG. 7B as described herebelow. The leading edges 42 and 44 are substantially rounded to provide smooth, free gliding movement of the device 10 against the filler material F as the device 10 is moved longitudinally in the direction of the arrows in FIG. 6.

The adhesive pad or member 22 is formed of 2# density open-cell polyester foam material of a highly compressible nature. As best seen in FIG. 5, each replaceable abrasive member 22 includes an adhered abrasive layer 25 which typically has a fabric-reinforced sanding surface of 80 to 120 grit, preferably 80 aluminum oxide grit with PSA backing. The opposite surface 24 is adhesively coated as with double-sided adhesive tape and covered with a protective backing prior to use (not shown).

The generally rectangular cross section of the abrasive member 22 shown in phantom, become slightly compressed at the side margins 22*a* and 22*b* when adhesively attached to arcuate facing surface 17. Note in FIG. 5 the small spacing between the alignment recesses 26 and 28 which assist in precise alignment of the abrasive member 22. These recesses 26 and 28 are preferably formed by inward offset of arcuate relief surfaces 30 and 32.

As best seen in FIG. 6, the device 10 in use is firmly pressed against the bullnose cornerbead D and then moved longitudinally thereof in the direction of the arrows along the length of the bullnose joint D to abrasively remove the cured excess filler material E and to finish sand the exposed radiused portions of each bullnose cornerbead D. Again, the guide runners 18 and 20, in cooperation with the concaved contour of the abrasive member 22, substantially match or mate with the transverse cross section of the bullnose cornerbead D and adjacent drywall panels as best described in FIG. 7B below.

Referring now to FIG. 7A, my prior patented device is there shown generally at numeral 10'. This prior device 10' also includes an elongated molded plastic rigid body 12' having a handle 14' attached to the convex or back surface thereof which defines a hand-holding opening (not there shown) for grasping by the user. The central longitudinally extending inner or facing surface 17' of the molded body 12' is also generally concaved and cylindrically circular in cross section. An abrasive layer 22' formed of open non-woven fibrous abrasive material, namely SCOTCH-BRITE by 3M Company, is attached by an adhesive layer 24' in longitudinally coextensive position with the central facing surface 17'. Note that the width of each abrasive layer 22' is such that the side margin 22*a*' and 22*b*' substantially coincide with the longitudinal edges H and J of the Unexposed rounded central portion of the bullnose cornerbead D in the in-use position shown. Note further that the abrasive pad 22' requires relatively little compression in order for the guide rails 18' and 20' to make contact against the filler surfaces F and G.

Still referring to 7A, with respect to the radius M of the cornerbead D, the guide rails 18' and 20' are somewhat close to the edges H and J of the cornerbead D and, for spacial reference, are oriented within a sector angle Q starting at an angle P forwardly of imaginary line N which is drawn perpendicular to a central plane O passing longitudinally through the device 10'. Moreover, the angle Q representing the angular or sector width of the contact surfaces of the guide rails 18' and 20' is about ten degrees. Note that the included sector angle of the bullnose cornerbead D is 90° as shown about the center of radius M.

Referring now to FIG. 7B, improvements in the present invention are there more clearly shown and may be better understood. Initially, to cause the guide runners or rails 18 and 20 to make contact against the filler material F and G, a firm force against handle 14 in the direction of arrow S is required to compress the abrasive pad 22 sufficiently. That is to say that, in referring to FIG. 5 as well, the central portion of the abrasive member 22 compresses from numeral 50 in FIG. 5 to numeral 54 in FIG. 7B, while the side margins 22*a* and 22*b* compress from 52 in FIG. 5 down to 56 in FIG. 7B. Numerically in preferred embodiment, a uniform thickness of each abrasive member 22 is approximately ½ inch. However, when in use as seen in FIG. 7B, the central portion compresses down at 54 to approximately 0.2" or down to about 40% of its initial thickness while the side margins 22*a* and 22*b*, compress down to approximately 0.28" or about 56% of their relaxed thickness of ½".

To greatly increase compression required of each abrasive member 22 in order to make surface contact of the guide runners 18 and 20 against the filler material F and G has shown to be extremely effective in allowing the abrasive layer or surface 25 to accomplish its intended task more easily and uniformly across the entire width and length of the outer surface of the bullnose corner D. The overall width of each abrasive member 22 is slightly increased so that the side margins 62 and 64 of the abrasive layer 25 extend very slightly beyond the side margins of the bullnose corner D. This slight overhang has shown to more effectively blend the filler material F and G to the side margins H and J of the bullnose corner D.

Still referring to FIG. 7B, the invention 10 is further enhanced in sanding effectiveness and stability by very slightly enlarging and extending the reach of each of the guide runners 18 and 20 with respect to the cornerbead D. Shown graphically, the guide runners 18 and 20 are increased in width about ⅛" or less and moved further from the side margins H and J and the center of the radius M of the cornerbead D. The sector angle 60 is oriented rearwardly at an angle 58 with respect to a plane N which is orthogonal to the central plane O of the cornerbead D and the device 10 when properly positioned as shown. The guide runner width is thus broadened through a sector angle 60 of approximately 15°. When compared to the same graphic analysis of the '306 device in FIG. 7A, the benefit of enhanced accuracy and stability of the present invention 10 as the guide runners 18 and 20 glide along the filler surfaces F and G should now be quite apparent.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated body having a concave-shaped central longitudinal portion positioned between two spaced, straight, parallel guide runners disposed along longitudinal margins of said elongated body;

a handle means extending away from said elongated body;

a highly compressible abrasive member releasably attachable on one surface thereof, and contoured to said central longitudinal portion and having an exposed abrasive surface on another surface thereof for mateable sanding and cleaning engagement against substantially only the bullnose cornerbead and drywall filler compound thereon;

said guide runners, in cooperation with said abrasive member, substantially mating against adjacent drywall panels and the bullnose cornerbead, respectively, whereby substantially only the bullnose cornerbead and drywall filler compound thereon comes into sanding contact with said abrasive layer;

said abrasive member being compressed a substantial amount of a thickness thereof to establish contact between both of said guide runners and the respective adjacent drywall panels whereby a substantial biasing pressure is established between said abrasive surface and the bullnose cornerbead;

each side margin of said central longitudinal portion is defined by an alignment recess, said alignment recesses spaced apart a distance across said central longitudinal portion substantially equal to a width of said abrasive member to establish lateral placement of said abrasive member with respect to said guide runners.

2. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated body having a concave-shaped central longitudinal portion positioned between two spaced, straight, parallel guide runners disposed along longitudinal margins of said elongated body;

a handle means extending away from said elongated body;

a highly compressible abrasive member releasably attachable on one surface thereof to said central longitudinal portion and having an exposed abrasive surface on another surface thereof for mateable sanding and cleaning engagement against substantially only the bullnose cornerbead and drywall filler compound thereon;

said guide runners being substantially mateable against adjacent drywall panels on either side of the bullnose cornerbead whereby said central longitudinal portion is positioned a certain distance X from the bullnose cornerbead;

said abrasive member having a thickness generally equal to about 2X and, when releasably attached to said central longitudinal portion, is compressed a substantial amount of the thickness 2X down to about X to establish simultaneous contact between both of said guide runners against the respective adjacent drywall panels whereby a substantial biasing pressure is thereby automatically established between said abrasive surface and the bullnose cornerbead.

3. A bullnose cornerbead sanding and cleaning device as set forth in claim 2, wherein:

the bullnose cornerbead defines a sector of a circle extending through substantially less than 180°, while said guide runners extend through sectors of the circle substantially greater than 180° whereby greater alignment accuracy and stability of said device in use is achieved.

4. A bullnose cornerbead sanding and cleaning device for removing cured drywall filler compound from, and finish sanding of, a bullnose cornerbead which forms a lengthwise extending raised rounded corner joint between adjacent drywall sheets of a drywall installation comprising:

an elongated body having a concave cylindrically shaped central longitudinal portion evenly positioned between two spaced, straight, parallel guide runners disposed along longitudinal margins of said elongated body;

a handle means extending away from said elongated body;

a highly compressible flat abrasive member releasably attachable on a first surface thereof to said central longitudinal portion, said abrasive member having an exposed abrasive surface on a second surface thereof for sanding and cleaning engagement with the bullnose cornerbead and excess drywall filler compound thereon;

said first surface assuming the cylindrical shape of said central longitudinal portion when releasably attached thereto whereupon said second surface is non-compliant in shape to that of the bullnose cornerbead;

said guide runners, when held in simultaneous mating alignment against drywall panels on either side of the bullnose cornerbead, causing said abrasive member to be automatically compressed a predetermined substantial amount of about half of a thickness of said abrasive member whereby a substantial biasing pressure is established between said abrasive surface and the bullnose cornerbead.

* * * * *